US011535343B2

(12) United States Patent
You et al.

(10) Patent No.: US 11,535,343 B2
(45) Date of Patent: Dec. 27, 2022

(54) INFLATABLE FOILBOARD

(71) Applicant: Starboard Co. Ltd., Samutprakarn (TH)

(72) Inventors: Tiesda You, Samutprakarn (TH); Raúl Grigore Delgado Naranjo, Samutprakarn (TH)

(73) Assignee: Starboard Co. Ltd., Samutprakarn (TH)

( * ) Notice: Subject to any disclaimer, the term of this patent is extended or adjusted under 35 U.S.C. 154(b) by 10 days.

(21) Appl. No.: 17/143,225

(22) Filed: Jan. 7, 2021

(65) Prior Publication Data

US 2022/0212761 A1 Jul. 7, 2022

(51) Int. Cl.

| | |
|---|---|
| ***B63B 32/51*** | (2020.01) |
| ***B63B 32/66*** | (2020.01) |
| ***B63B 7/08*** | (2020.01) |
| ***B63B 32/60*** | (2020.01) |

(52) U.S. Cl.

CPC ..... *B63B 32/51* (2020.02); *B63B 7/085* (2013.01); *B63B 32/60* (2020.02); *B63B 32/66* (2020.02)

(58) Field of Classification Search

CPC ..... B63B 1/24; B63B 1/242; B63B 1/248; B63B 1/26; B63B 1/28; B63B 7/085; B63B 32/51; B63B 32/56; B63B 32/60; B63B 32/64; B63B 32/66; B63B 32/70; B63B 34/22; B63B 34/40; B63B 34/52

See application file for complete search history.

(56) References Cited

U.S. PATENT DOCUMENTS

| | | | | |
|---|---|---|---|---|
| 3,657,753 A * | 4/1972 | Le Blanc, Sr. | B63B 32/51 441/66 |
| 4,159,689 A * | 7/1979 | Odoj | B63B 32/51 114/39.14 |
| 4,253,209 A * | 3/1981 | Carn | B63B 32/51 114/39.14 |
| 5,351,637 A * | 10/1994 | Brenckmann | B63B 32/51 114/39.14 |
| 5,809,926 A * | 9/1998 | Kelsey | B63B 41/00 114/274 |
| 6,386,932 B1 * | 5/2002 | Murphy | B63B 43/12 114/274 |
| D737,392 S * | 8/2015 | Thomas | B63B 32/60 D21/778 |
| 10,597,118 B2 * | 3/2020 | Montague | B63H 21/17 |

FOREIGN PATENT DOCUMENTS

| | | |
|---|---|---|
| CH | 626576 A5 * | 11/1982 |
| CN | 207683737 U * | 8/2018 |
| CN | 213262843 U * | 5/2021 |
| DE | 2742989 A1 * | 4/1979 |

* cited by examiner

*Primary Examiner* — Ajay Vasudeva
(74) *Attorney, Agent, or Firm* — George McGuire

(57) ABSTRACT

An inflatable foilboard or hydrofoil board comprises an inflatable board having a rigid platform on which a user stands. A mast extends from the platform through the board and into the water below. A hydrofoil is fixed to the base of the mast.

6 Claims, 4 Drawing Sheets

INFLATABLE FOILBOARD

FIELD OF THE INVENTION

The present invention relates to water sports boards. In particular, the invention is directed to a water sports board having an inflatable rim and a hydrofoil extending beneath the board.

BACKGROUND TO THE INVENTION

"Foilboards", also known as "hydrofoil boards", are water sports boards which have a "mast" or "strut" extending underneath, onto which a hydrofoil is attached. This arrangement provides lift to the board, such that above a certain speed the board will be raised above the water level. This in turn reduces drag on the board, and allows for greater speeds and manoeuvrability when compared with other water sports boards.

Such boards can be bulky. In order to create a board which can be more easily transported, and which provides better flotation at low speeds, a recent innovation is an inflatable foilboard. Inflatable foilboards include an inflatable body to which a top plate is fixed (on which a user can stand) and an under plate is fixed (from which the hydrofoil extends).

Inflatable boards are inherently less rigid than solid boards. As such, they must be pumped to high internal pressures in an attempt to provide rigidity. In the case of inflatable foilboards, this is particularly problematic because control of the hydrofoil is achieved through the user's feet. The (compressed) air gap between the top plate and the bottom plate acts to dissipate changes in weight transference, limiting the precision with which the hydrofoil can be controlled.

The present invention seeks to address this problem with inflatable foilboards.

SUMMARY OF THE INVENTION

The key to the present invention is that a hydrofoil mast passes through an inflatable board, and attaches directly to a top plate. When the inflatable board is above water level, the entire weight of a user passes directly from the top plate to the hydrofoil mast, bypassing the inflatable board.

According to one aspect of the present invention there is provided a water sports board having:

(a) a rigid standing surface;

(b) a rigid mast extending downwardly from the standing surface;

(c) at least one hydrofoil fixed to the mast; and (d) an inflatable body fixed to the rigid standing surface, the inflatable body having an aperture through which the rigid mast can pass such that the inflatable body is located between the rigid standing surface and the at least one hydrofoil.

In a preferred embodiment the inflatable body defines an upper surface of the water sports board, the upper surface having a length, and whereby the rigid standing surface has a length between 30% and 70% that of the length of the upper surface.

The rigid mast may have an upper flange arranged to connect to the rigid standing surface. The upper flange may have a length between 15% and 25% that of the length of the rigid standing surface.

The aperture in the inflatable body preferably has flexible side walls, such that inflation of the inflatable body causes the side walls to press against the rigid mast.

The aperture of the inflatable body is preferably located closer to a tail of the water sports board than to a nose. Preferably, the aperture of the inflatable body is centred between 15% and 35% of the distance from the tail of the water sports board to the nose of the water sports board.

The hydrofoil may be directly fixed to the mast. Preferably, the hydrofoil is fixed to a supporting structure which is itself fixed to the mast.

BRIEF DESCRIPTION OF THE DRAWINGS

It will be convenient to further describe the invention with reference to preferred embodiments of the present invention. Other embodiments are possible, and consequently the particularity of the following discussion is not to be understood as superseding the generality of the preceding description of the invention. In the drawings.

DETAILED DESCRIPTION OF PREFERRED EMBODIMENTS

Figure 1:
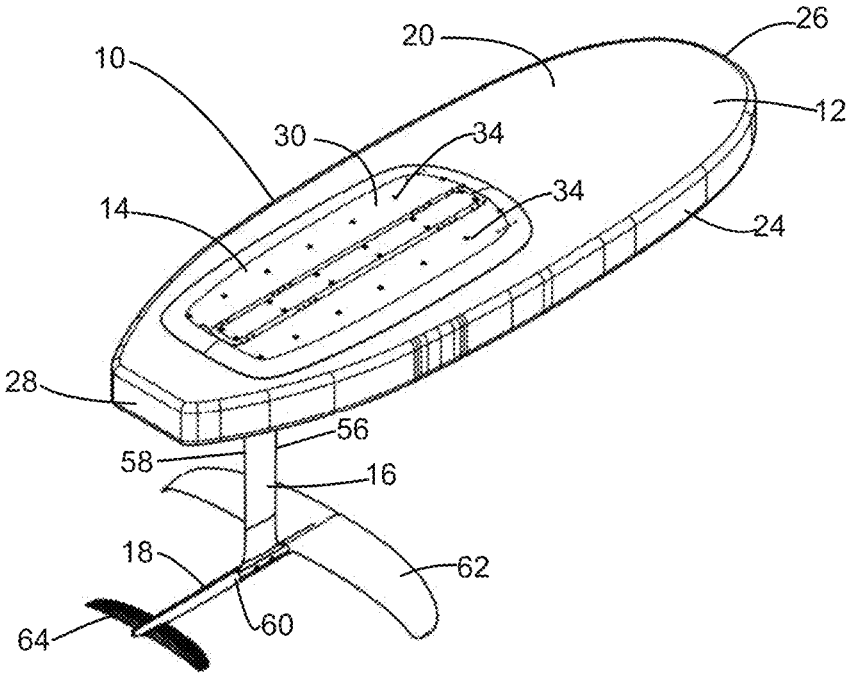
FIG. 1 is an upper perspective of a water sports board in accordance with the present invention.
Figure 2:
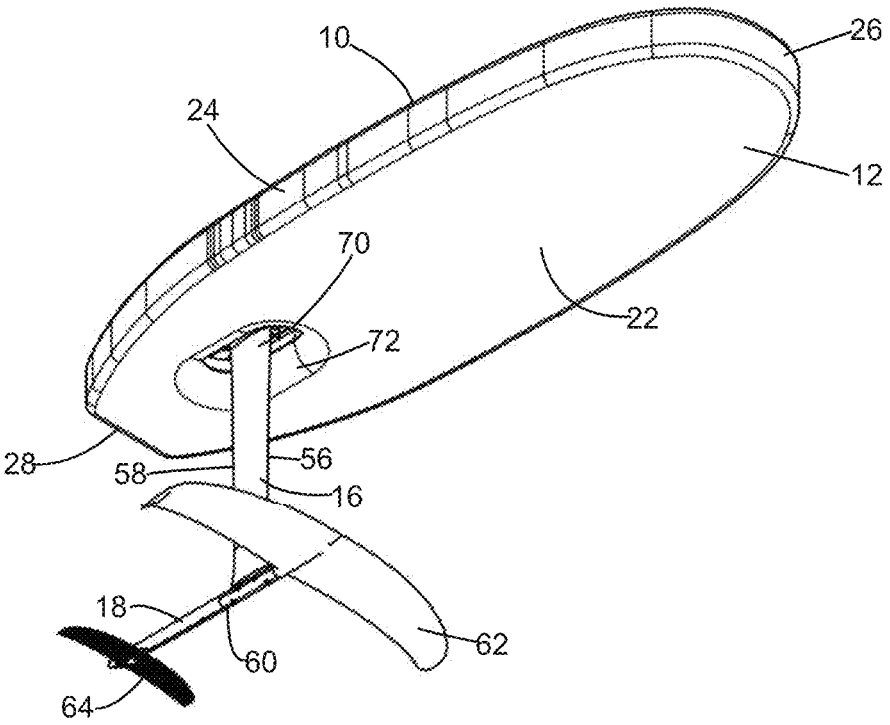
FIG. 2 is a lower perspective of the water sports board of FIG. 1.
Figure 3:
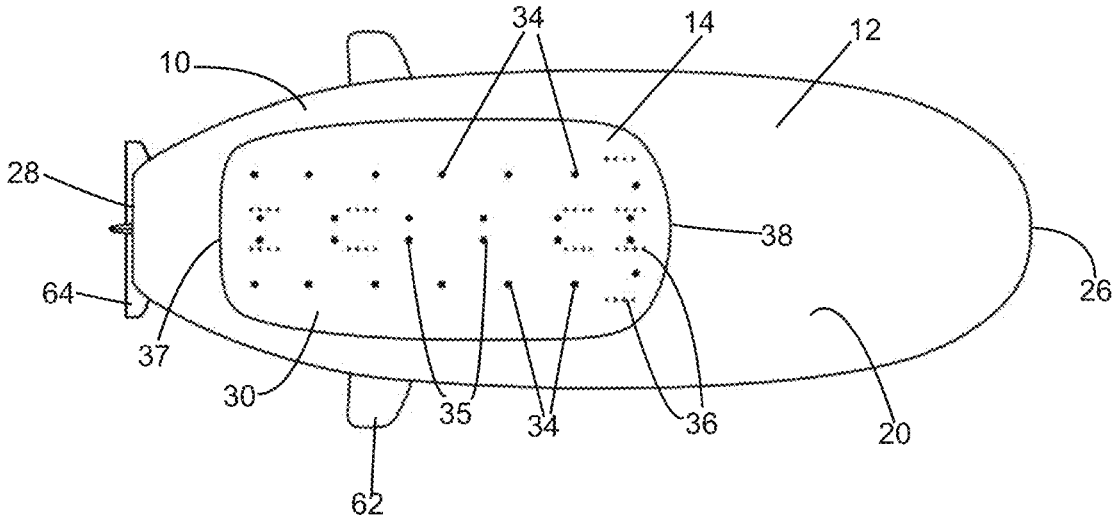
FIG. 3 is a plan view of the water sports board of FIG. 1.

Referring to the Figures, there is shown a water sports board 10 having an inflatable body 12, a rigid standing surface 14, a rigid mast 16, and a hydrofoil arrangement 18.

The inflatable body 12 has an upper surface 20, a lower surface 22, and a sidewall 24. FIGS. 1 to 4 show the inflatable body 12 in a fully inflated condition, whereby the upper surface 20 and lower surface 22 are generally flat, and are spaced apart by the sidewall 24. The upper surface 20 and lower surface 22 each extend from a nose 26 of the water sports board to a tail 28, defining the length of the water sports board 10.

The rigid standing surface 14 is fixed to the upper surface 20 of the inflatable body 12. The rigid standing surface 14 has an upper surface 30 and a lower surface 32. The upper surface 30 includes a plurality of apertures including outer apertures 34 which can be used to fix the rigid standing surface 14 to the upper surface 30; central apertures 35 which can be used for attaching a stiffening element; and smaller apertures 36 to which foot straps (not shown) and other accessories can be mounted.

The rigid standing surface 14 has a length about half that of the water sports board 10. The rigid standing surface 14 is fixed to generally a rear side of the upper surface 20 of the inflatable body 12. The arrangement is such that a rear end 37 of the rigid standing surface 14 is located about 10% of the distance from the tail 28 to the nose 26 of the water sports board 10, and a front end 38 of the rigid standing surface 14 is located about 40% of the distance from the nose 26 to the tail 28 of the water sports board 10.

The lower surface 32 of the rigid standing surface 14 has a plurality of mounting points 40 arranged to affix to the upper surface 20 of the inflatable body 12. The lower surface 32 includes a central reinforcing rib 42.

The rigid mast 16 has a flange plate 50 at an upper end thereof. The flange plate 50 is arranged to be fixed to the central reinforcing rib 42 by means of bolts 52. The flange plate 50 has a length about 20% that of the rigid standing surface 14, and a width slightly greater than that of the central reinforcing rib 42. The flange plate 50 is fixed toward a rear of the rigid standing surface 14, with a rear end 54 located about 10% of the distance from the rear end 37 to the front end 38 of the rigid standing surface 14.

The rigid mast 16 extends downwardly of the rigid standing surface 14. The rigid mast 16 is arranged to have minimal drag in the water. As such, it has a leading edge 56 oriented towards the nose 26 of the water sports board 10 and a trailing edge 58 oriented towards the tail 28 of the water sports board 10. The rigid mast 16 has a general hydrofoil shape.

The hydrofoil arrangement 18 is formed by a supporting structure comprising a longitudinal spar 60 which extends from a lower edge of the rigid mast 16, with a leading hydrofoil 62 extending laterally of a forward end of the spar 60 and a rear hydrofoil 64 extending laterally of the rear end of the spar 60. It will be appreciated that alternative hydrofoil arrangements can be provided in order to establish different properties.

In order to accommodate the rigid mast 16, the inflatable body 12 includes an aperture 70 extending between the upper surface 20 and the lower surface 22. The aperture 70 has a length about 20% that of the water sports board 10, and is centred at about 25% of the distance from the tail 28 to the nose 26 of the water sports board 10.

The aperture 70 has flexible side walls 72.

The aperture 70 is sized such that when the inflatable body 12 is deflated, the aperture 70 is sufficiently large for the flange plate 50 to be passed through the aperture 70 and bolted to the rigid standing surface 14 by means of the bolts 52.

Figure 4:
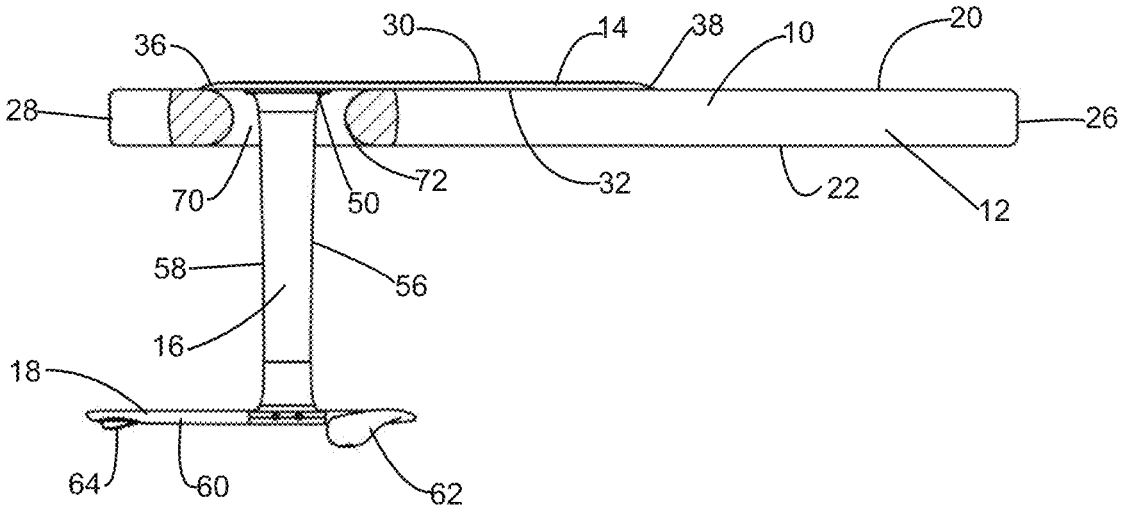
FIG. 4 is a cross section through the water sports board of FIG. 1.
Figure 5:
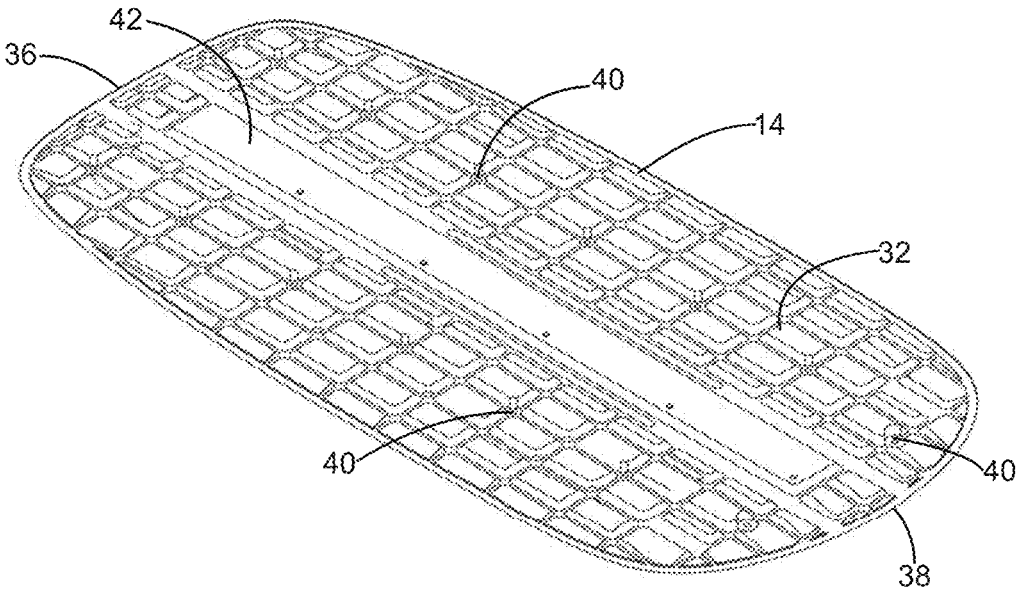
FIG. 5 is an under view of a standing surface within the water sports board of FIG. 1.
Figure 6:
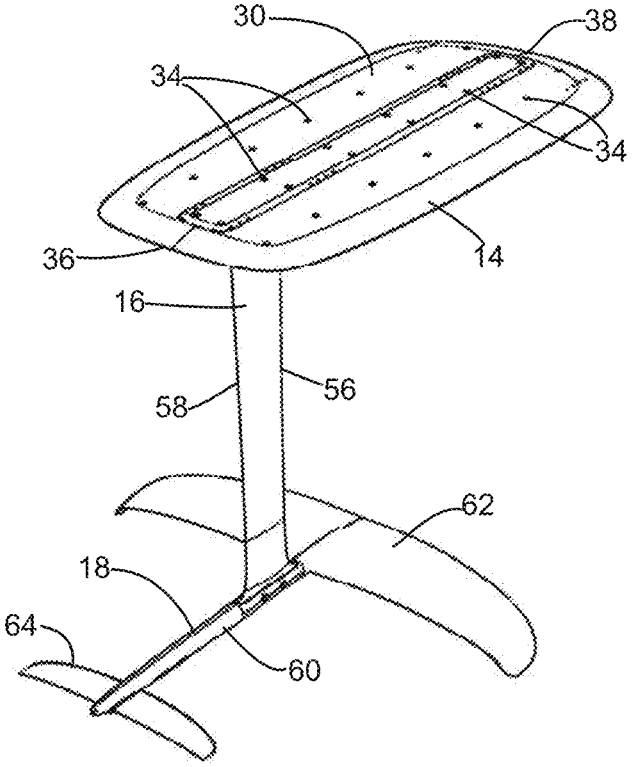
FIG. 6 is an upper perspective of a rigid structure from within the water sports board of FIG. 1.
Figure 7:
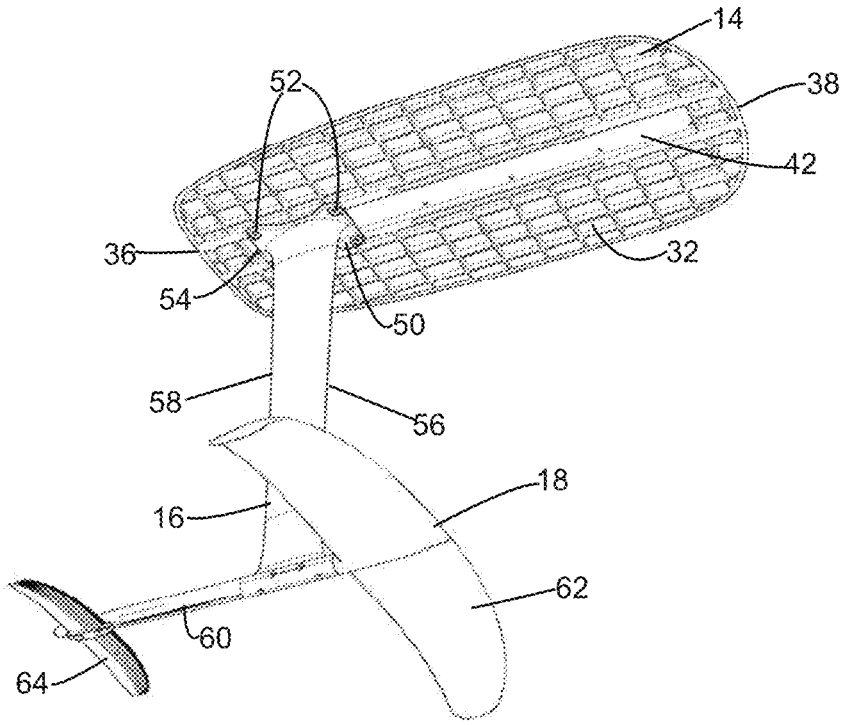
FIG. 7 is a lower perspective of the rigid structure of FIG. 6.
Figure 8:
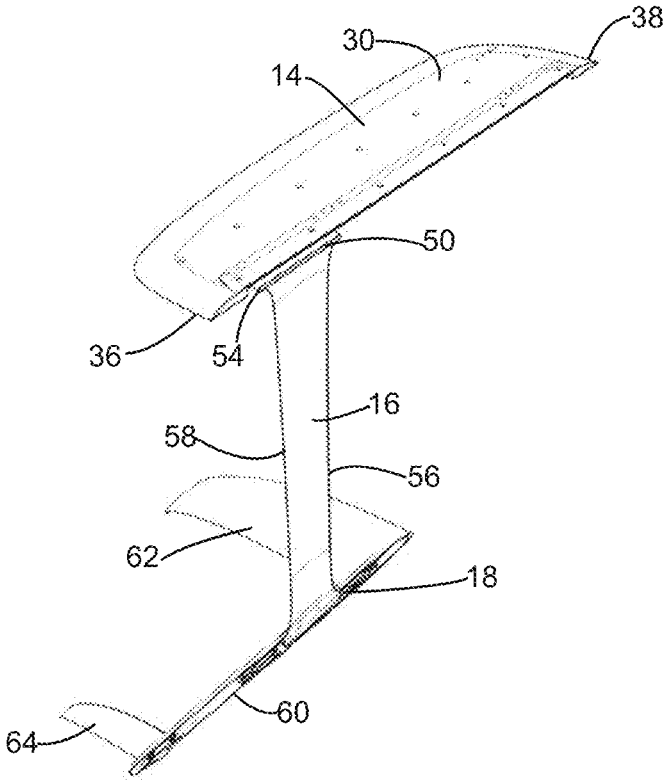
FIG. 8 is a cut-away view of the rigid structure of FIG. 6.

Inflation of the inflatable body 12 causes the flexible side walls 72 to expand inwardly, pressing against the rigid mast 16. As shown in FIG. 4, the flexible side walls 72 are spaced from the leading edge 56 and trailing edge 58 of the rigid mast 16, with the flexible side walls 72 of the aperture 70 pressing against side walls of the rigid mast 16.

To use the water sports board 10 (once inflated), a user stands on the upper surface 30 of the rigid standing surface 14, with the lower surface 22 of the inflatable body 12 floating on the water's surface.

When a required speed is reached, the hydrofoil arrangement 18 provides sufficient lift that the lower surface 22 of the inflatable body 12 rises above the water's surface. In this situation, the entire weight of the user passes via the rigid standing surface 14 and the mast 16 to the hydrofoil arrangement 18, essentially bypassing the inflatable body 12. Control of the water sports board 10 is thus effected by weight shift of the user on the rigid standing surface 14, with the inflatable body 12 having no effect other than providing a small degree of wind resistance.

Modifications and variations as would be apparent to a skilled addressee are deemed to be within the scope of the present invention.

The invention claimed is:

1. A water sports board having:

(a) a rigid standing surface;

(b) a rigid mast extending downwardly from the standing surface;

(c) at least one hydrofoil fixed to the mast; and (d) an inflatable body fixed to the rigid standing surface, the inflatable body having an aperture through which the rigid mast can pass such that the inflatable body is located between the rigid standing surface and the at least one hydrofoil, wherein the aperture of the inflatable body is centred between 15% and 35% of the distance from the tail of the water sports board to the nose of the water sports board.

2. A water sports board as claimed in claim 1, wherein the inflatable body defines an upper surface of the water sports board, the upper surface having a length, and whereby the rigid standing surface has a length between 30% and 70% that of the length of the upper surface.

3. A water sports board as claimed in claim 1, wherein the rigid mast has an upper flange arranged to connect to the rigid standing surface.

4. A water sports board as claimed in claim 3, wherein the upper flange has a length between 15% and 25% that of a length of the rigid standing surface.

5. A water sports board as claimed in claim 1, wherein the aperture in the inflatable body has flexible side walls, such that inflation of the inflatable body causes the side walls to press against the rigid mast.

6. A water sports board as claimed in claim 1 wherein the hydrofoil is fixed to a supporting structure which is itself fixed to the mast.

* * * * *